United States Patent [19]

Fast et al.

[11] Patent Number: 4,761,904

[45] Date of Patent: Aug. 9, 1988

[54] LABEL HOLDER

[75] Inventors: Jacob Fast, 7561 NW. 9th St., Plantation, Fla. 33317; Michael M. Smith, Ft. Lauderdale, Fla.

[73] Assignee: Jacob Fast, Plantation, Fla.

[21] Appl. No.: 772,670

[22] Filed: Sep. 5, 1985

[51] Int. Cl.[4] ..... G09F 3/00

[52] U.S. Cl. ..... 40/308; 40/642; 40/665

[58] Field of Search ..... 40/2, 20, 21, 10, 308

[56] References Cited

U.S. PATENT DOCUMENTS

| | | | |
|---|---|---|---|
| 2,768,458 | 10/1956 | Anania | 40/21 |
| 3,197,899 | 8/1965 | Twentier | 40/21 C |
| 3,228,129 | 1/1966 | Gwinn | 40/21 |
| 3,539,204 | 11/1970 | Keller | 40/308 |
| 3,782,747 | 1/1974 | Hamilton | 40/308 |
| 3,785,337 | 1/1974 | Flowerday | 40/21 |

*Primary Examiner*—Gene Mancene
*Assistant Examiner*—Wenceslao J. Contreras
*Attorney, Agent, or Firm*—Holman & Stern

[57] ABSTRACT

A label holder for a product information label is suspended from a wire rod forming part of a wire basket, wire shelf, or the like containing the product, the label holder having elongate tabs along the upper margin which loop around the rod and attach to the body of the holder. The tabs have adhesive inner surfaces which are pressed into engagement with the rod so as to stabilize the label holder against swaying when traversed by a bar code reader.

5 Claims, 1 Drawing Sheet

LABEL HOLDER

BACKGROUND OF THE INVENTION

This invention relates to a label holder more particularly for use in supporting a product information label on a shelf, basket, tray, or the like which is constructed from wire rod.

In various wholesaling or retailing operations, merchandise may commonly be displayed or stored on wire shelves or in wire baskets or the like, and it is necessary or desirable to provide a product information label to indicate merchandise pricing or the like, in association with the shelf, basket or the like. Moreover, it has been increasingly common for product labels to include bar codes thereon to be read by an electronic bar code reader and it is desirable that the label should be supported in a sufficiently stabilized manner for such a reader, when passed across the label, adequately to pick up the bar code information.

It is a primary object of the invention to provide a label holder which can be suspended from a wire rod of a wire shelf, basket or the like while providing the stabilization required when scanning information thereon by a bar code reader or the like.

SUMMARY OF THE INVENTION

The invention provides a label holder, for the purpose indicated, in the form of a card of suitable sheet material, such as stiff plastic sheet, well known per se for use in label holding devices, the card including at least one elongate tab extending from one margin thereof for looping around a wire rod of a shelf, basket or the like, attachment means for releasably securing a distal end of the tab to the body of the card when the tab is looped around the rod whereby the holder is suspended from the rod, and means for minimizing sway of the suspended holder so as to stabilize the holder for scanning of a label associated therewith by a bar code reading device and the like, the sway minimizing means, at least in a preferred form of the invention, comprising a contact adhesive on a surface of the tab for engaging the rod, so that when the holder is applied to the rod as aforesaid, the tab may be squeezed around the rod and opposed adhesive surface portions of the tab below the rod may be squeezed together to provide stabilized sway-minimizing adhesion of the holder to the rod.

In a preferred form of the invention, the card may be of generally rectangular form with a pair of the adhesive tabs on an upper margin thereof. The attachment means conveniently may comprise an arrowhead type formation at the distal end of each tab and a complimentary receiving slit in the body of the card into which the arrowhead is pushed after looping the tab around the rod. The adhesive surface of each tab may be covered with release paper which is removed prior to use. Thus, to attach the holder to a wire rod, the release paper is removed, the tabs are looped around the rod, the attachment means suitably secured, and the tabs are pressed around the rod into conformance therewith so as to adhere the tabs to the rod and also to adhere the tab portions below the rod together. It is found, in practice, that adhesion of the label holder in the manner described adequately stabilizes same against sway when scanned by a bar code reader sufficient to ensure accurate reading of a bar code.

In accordance with an important feature of the invention, in order to improve conformance of the tabs to the rod, the adhesive covered portions of the tabs may be longitudinally slit so as to increase flexibility. Further, the lower margin of the card may be provided with a fold-up bar code reader guide ledge. Labels may be imprinted on or adhesively applied to the front face of the card.

Additional features and advantages of the invention will be apparent from the ensuing description and claims read in conjunction with the accompanying drawings.

DESCRIPTION OF PREFERRED EMBODIMENTS

Figure 2:
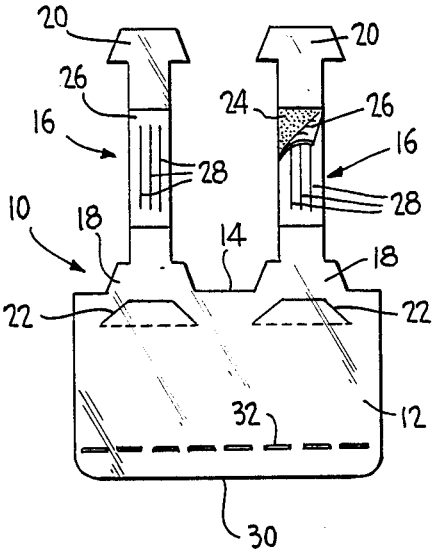
FIG. 2 is a general view of the label holder as manufactured.

Referring initially to FIG. 2, there is shown a label holder 10 which may, for example, be die-cut from a sheet of stiffish plastic of a type well known for the purpose. The label holder is in the form of a card having a generally rectangular body portion 12 with an upper margin 14, and a pair of elongate tabs 16 extending from the upper margin. Each tab has an enlarged base portion 18 forming a reinforcement at the junction of the tab and body, and an arrowhead-like formation 20 at its distal end. The arrowhead portions 20 form tab attachments in conjunction with complimentary slits 22 in the card body adjacent margin 14.

Intermediate base portion 18 and formation 20, one surface of each tab is provided over a major portion of its length with a covering of contact adhesive 24 (of any suitable composition well known per se) covered by release paper 26. Further, the adhesive covered portion of the tab is formed with longitudinal flexibility enhancing die-cut slits 28, (three in number in the illustrated embodiment).

Figure 1:
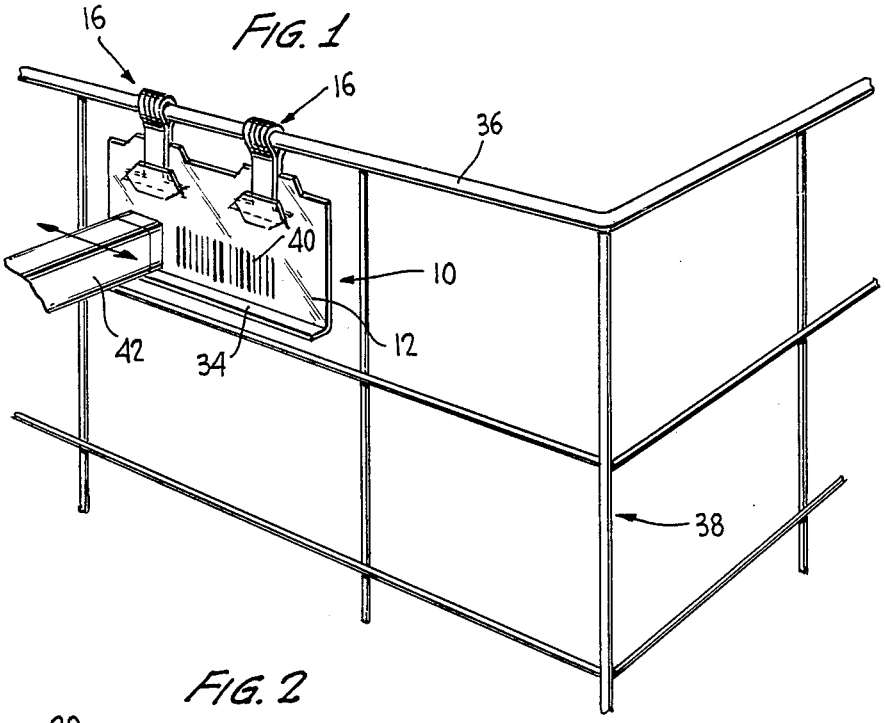
FIG. 1 is an in-use perspective view of a label holder in accordance with the invention mounted on a wire basket.
Figure 3:
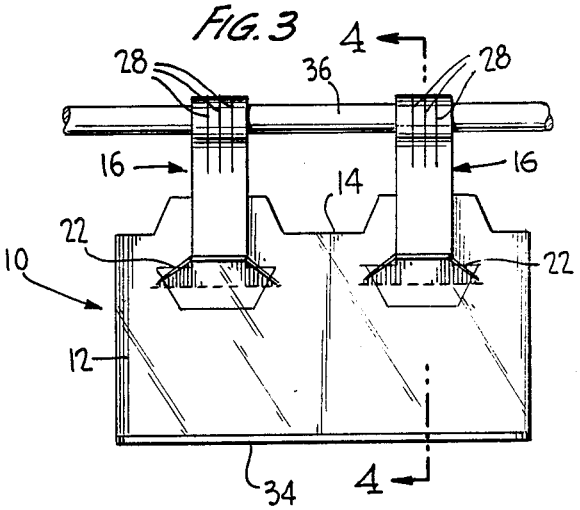
FIG. 3 is a somewhat enlarged in-use front elevational view of the label holder.
Figure 4:
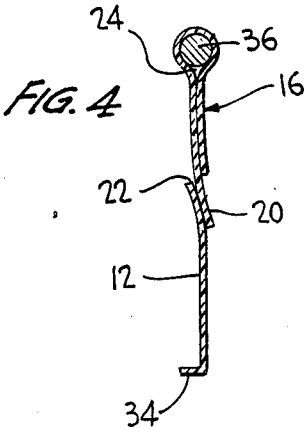
FIG. 4 is a sectional view on line 4—4 of FIG. 3.

Adjacent lower margin 30 of body portion 12, the holder is formed with a transverse score or bend line 32 for forming a fold-up bar code reader guide ledge 34 (FIGS. 1, 3 and 4) of the type disclosed in co-pending U.S. patent application Ser. No. 574,617 filed Jan. 27, 1984, and the contents of which is expressly incorporated herein by reference.

Label holder 10 is specifically adapted for suspension from a wire rod 36, which in the illustrated embodiment is part of a wire basket 38, but which may equally well be part of a wire shelf or the like for displaying or storing merchandise. To apply the holder to the rod, release papers 26 are removed from tabs 16 to expose the adhesive 24. The tabs are looped around the rod, secured by engagement of formations 20 in slits 22 and the tabs are then squeezed into conforming engagement with the rod so as to adhere them to the rod and so as to adhere adhesive surface portions of the tabs together below the rod. Conformance of the tabs around the rod is enhanced and facilitated by the presence of the slits 28.

Adhesive suspension of the holder from rod 36 serves to stabilize the holder and effectively preclude sway thereof sufficient to ensure adequate support of a bar code 40 (FIG. 1) which may be applied directly to the face of the holder of may be on an adhesive label, when the code is traversed by a bar code reader 42, the stabilized support of the code, in combination with the guide ledge 34, providing accuracy in reading the code.

For applications where the holders are to be suspended, for example, from a rod where there is a vertical support surface behind the suspended holder, holder sway when traversed by a bar code reader may not be a problem, and in such applications it may not be necessary to use adhesive on the holder suspension tabs.

While only a preferred embodiment of the invention has been described herein in detail, the invention is not limited thereby and modifications may be made within the scope of the attached claims.

We claim:

1. In combination with a wire rod forming a part of a product basket, shelf, and the like, a label holder suspended from the rod, the label holder comprising a card of sheet material and at least one elongate tab extending from an upper margin of the card, the tab being looped around the rod and secured to the car by attachment means on the end of the tab, the tab further being stabilized against swaying by contact adhesive on an inner surface thereof adhering the tab to the rod and the tab being slit longitudinally to improve conforming adhesion thereof around the rod.

2. The invention of claim 1 wherein the tab is pressed into engagement with the rod and is squeezed around the rod so that adhesive portions thereof under the rod are adhered together.

3. The invention of claim 1 wherein the tab is replicated along the upper margin of the card.

4. The invention of claim 1 wherein the attachment means comprises a headed formation on the end of the tab for engaging a complimentary slit in the card.

5. The invention of claim 1 wherein the card has a bar code reader guide ledge along the lower margin thereof.

* * * * *